US011051092B2

(12) United States Patent
Kaplan et al.

(10) Patent No.: US 11,051,092 B2
(45) Date of Patent: Jun. 29, 2021

(54) MODULAR SPEAKER COVER

(71) Applicant: SSV Works, Inc., Oxnard, CA (US)

(72) Inventors: Trevor Kaplan, Newbury Park, CA (US); Greg Orlando, Camarillo, CA (US); Jeremy Prater, Oxnard, CA (US)

(73) Assignee: SSV Works, Inc., Oxnard, CA (US)

( * ) Notice: Subject to any disclaimer, the term of this patent is extended or adjusted under 35 U.S.C. 154(b) by 0 days.

(21) Appl. No.: 16/850,438

(22) Filed: Apr. 16, 2020

(65) Prior Publication Data

US 2020/0245046 A1 Jul. 30, 2020

Related U.S. Application Data

(63) Continuation of application No. 16/174,225, filed on Oct. 29, 2018, now Pat. No. 10,667,027, which is a continuation of application No. 15/390,044, filed on Dec. 23, 2016, now Pat. No. 10,117,008.

(51) Int. Cl.
*H04R 1/02* (2006.01)

(52) U.S. Cl.
CPC ..... *H04R 1/023* (2013.01); *H04R 2499/13* (2013.01)

(58) Field of Classification Search
CPC ..... H04R 1/023; H04R 2499/13
USPC ..... 381/391
See application file for complete search history.

(56) References Cited

U.S. PATENT DOCUMENTS

| | | | |
|---|---|---|---|
| 4,196,791 | A | 4/1980 | Gottleb |
| 4,281,224 | A | 7/1981 | Castagna |
| 6,142,254 | A | 11/2000 | Claybaugh |
| D473,213 | S | 4/2003 | Abdo |
| 6,978,031 | B2 | 12/2005 | Garretson |
| D577,714 | S | 9/2008 | Monaghan |
| D579,919 | S | 11/2008 | Monaghan |
| 8,090,137 | B2 | 1/2012 | Tyan |
| 8,712,091 | B2 | 4/2014 | Taylor |
| 9,682,641 | B1 | 6/2017 | Subat |
| 2005/0213784 | A1 | 9/2005 | Garretson |
| 2007/0036369 | A1 | 2/2007 | David |
| 2014/0270322 | A1 | 9/2014 | Silverstein |
| 2015/0010194 | A1 | 1/2015 | Rodgers |
| 2016/0137106 | A1 | 5/2016 | Subat |

FOREIGN PATENT DOCUMENTS

WO 02019760 A3 1/2003

OTHER PUBLICATIONS

Office Action of U.S. Appl. No. 15/390,044; dated Dec. 13, 2017.
Office Action of U.S. Appl. No. 16/174,225; dated Jan. 2, 2019.
Office Action of U.S. Appl. No. 16/174,225; dated Jun. 28, 2019.

*Primary Examiner* — Sean H Nguyen
(74) *Attorney, Agent, or Firm* — Ferguson Case Orr Paterson

(57) ABSTRACT

Described herein is a modular speaker cover that is removably attachable to a speaker. This device can comprise a modular grille and a grille insert, wherein the grille insert is removably attached to the modular grille. The grille insert can be replaced with other grille inserts of various colors, shapes, textures, and materials. In some embodiment, the grille insert is permanently fixed to the modular grille.

15 Claims, 6 Drawing Sheets

FIG. 5
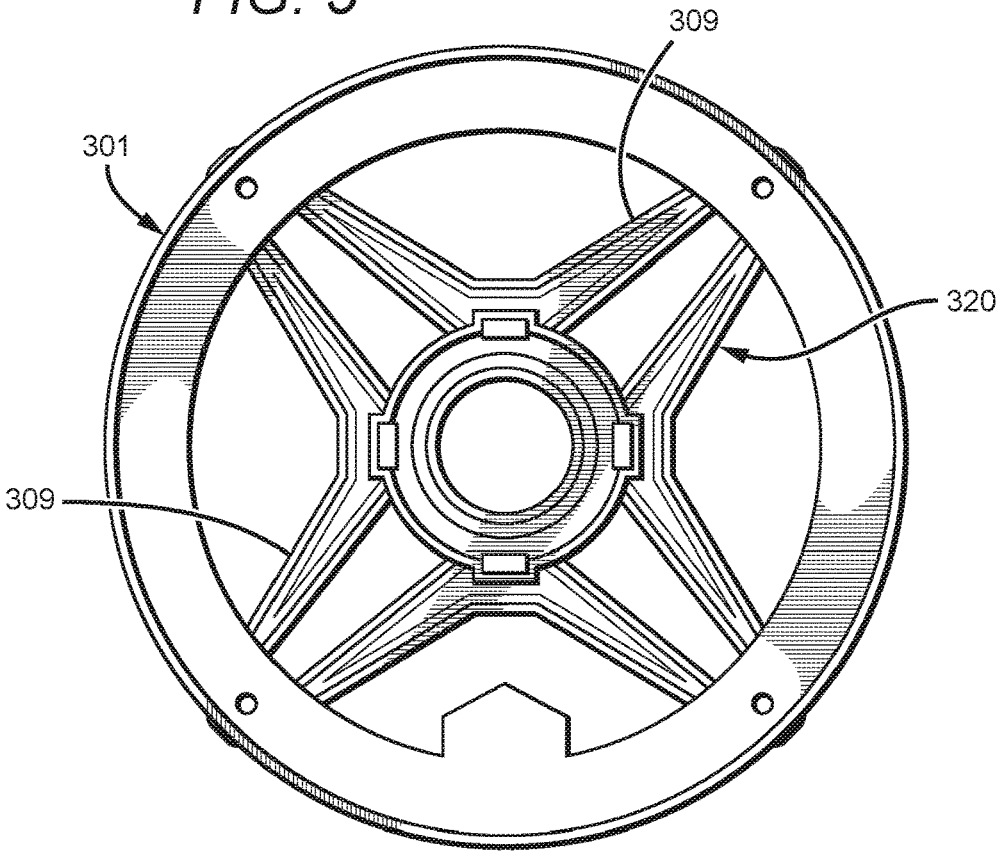
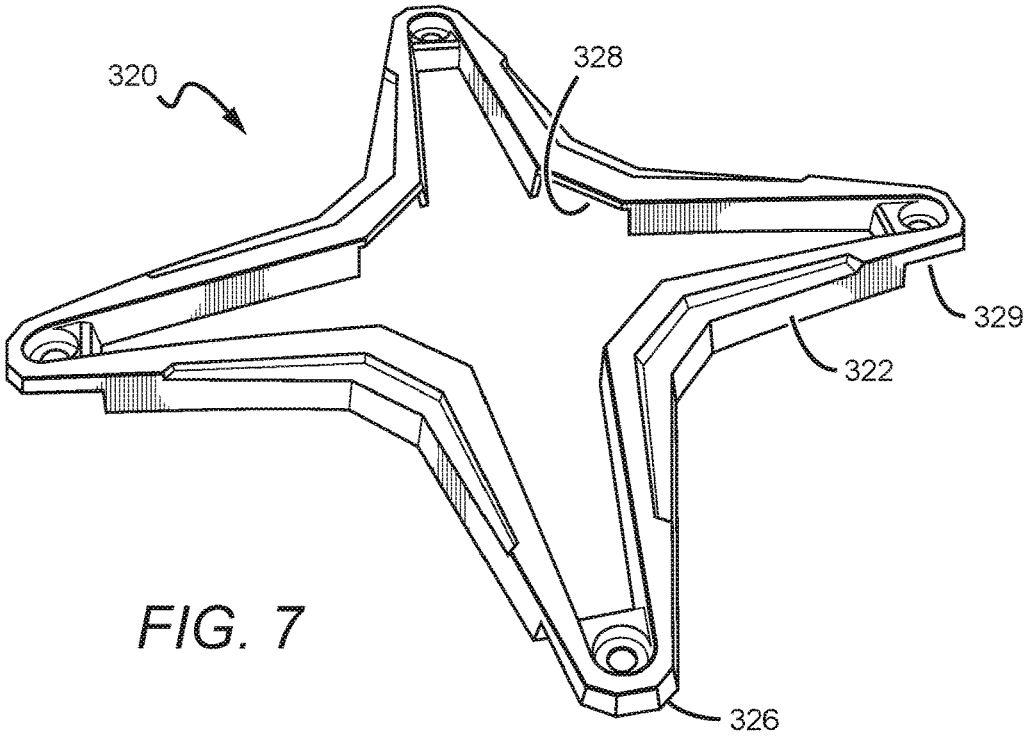
FIG. 7

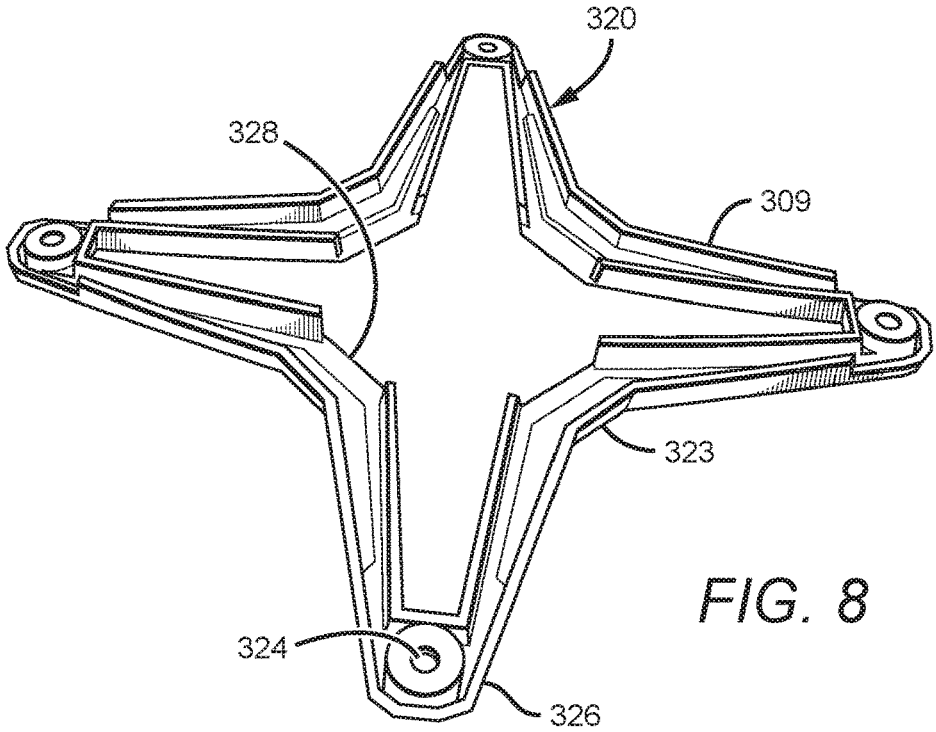
FIG. 8
FIG. 9
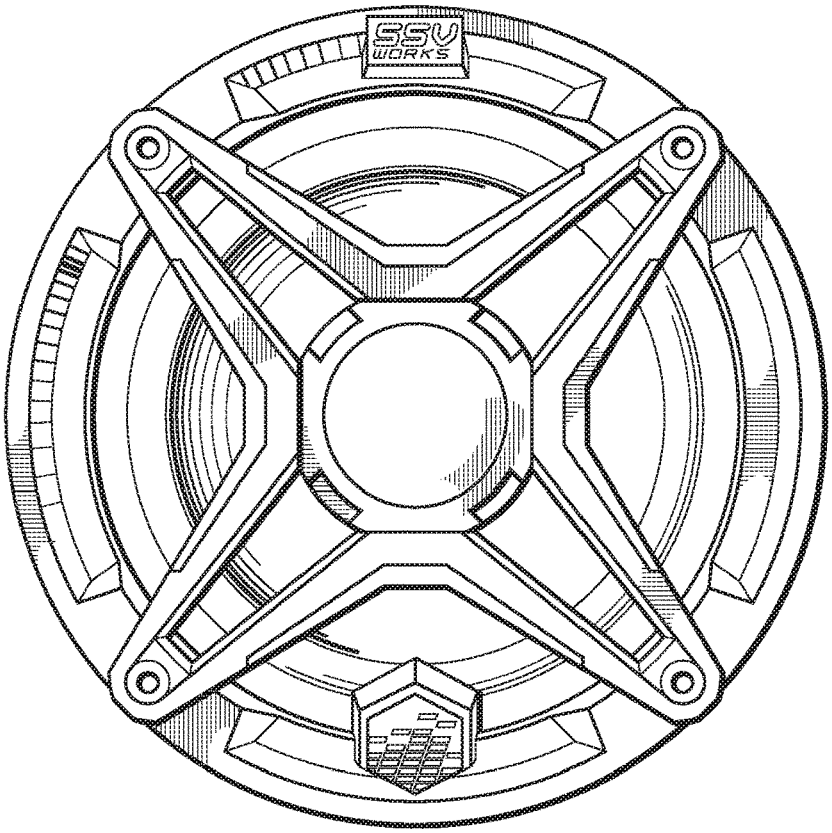

MODULAR SPEAKER COVER

RELATED APPLICATION

This application is a continuation of U.S. patent application Ser. No. 16/174,225, filed on 29 Oct. 2018, which is a continuation of U.S. patent application Ser. No. 15/390,044, filed on 23 Dec. 2016. The applications referenced in this paragraph are incorporated by reference as if set forth fully herein.

BACKGROUND

Field of the Disclosure

Described herein are devices relating generally to audio equipment, and specifically for speaker covers, for example, for use in a vehicle.

Description of the Related Art

A speaker grille is often combined with a speaker to protect it from impact with foreign objects. The speaker grille is typically coupled to the basket of the speaker and at least partially covers the face of the speaker. The speaker grille may or may not be removable from the speaker. A speaker grille's primary purpose is to protect the speaker from damage by contact with other objects.

One problem with conventional speaker grilles is that they are not easily replaceable with substitute speaker grilles, such as speaker grilles of various designs, colors, and textures. This problem arises particularly in the context of speaker grilles for vehicles, for example ATVs or UTVs, where the user may wish to color coordinate the interior of a vehicle. For instance, the user may wish to have the color of the speaker grille match the color of the gearbox and seat covers within the vehicle.

SUMMARY OF THE DISCLOSURE

Described herein is a modular speaker cover that is configured to be removably attached to a speaker basket. In some embodiments, the modular speaker cover is comprised of at least two parts: a modular grille and a grille insert. The grille insert fits over and is removably attachable to the modular grille and can be interchangeable with other grille inserts of various colors, shapes, and/or textures. The modular grille and the grille insert can both be attached to the speaker using the same means of connection such as, for example, the same screws, by aligning holes in the modular grille and grille insert to holes in the speaker basket.

In other embodiments, the modular speaker cover is a single piece that is comparable to the combined pieces of the modular grille and the grille insert. This type of modular speaker cover can be interchangeable with other modular speaker covers of various colors, shapes, and/or textures.

These and other further features and advantages of the invention would be apparent to those skilled in the art from the following detailed description, taken together with the accompanying drawings, wherein like numerals designate corresponding parts in the figures, in which:

BRIEF DESCRIPTION OF THE DRAWINGS

FIG. 5 is a bottom view of a modular speaker cover according to the embodiment of the present invention shown in FIG. 2;

FIG. 7 is a top perspective view of a grille insert according to the embodiment of the present invention shown in FIG. 2;

FIG. 8 is a bottom perspective view of a grille insert according to the embodiment of the present invention shown in FIG. 2; and FIG. 9 is a top view of a modular speaker cover according to another embodiment of the present invention.

DETAILED DESCRIPTION

Figure 1:
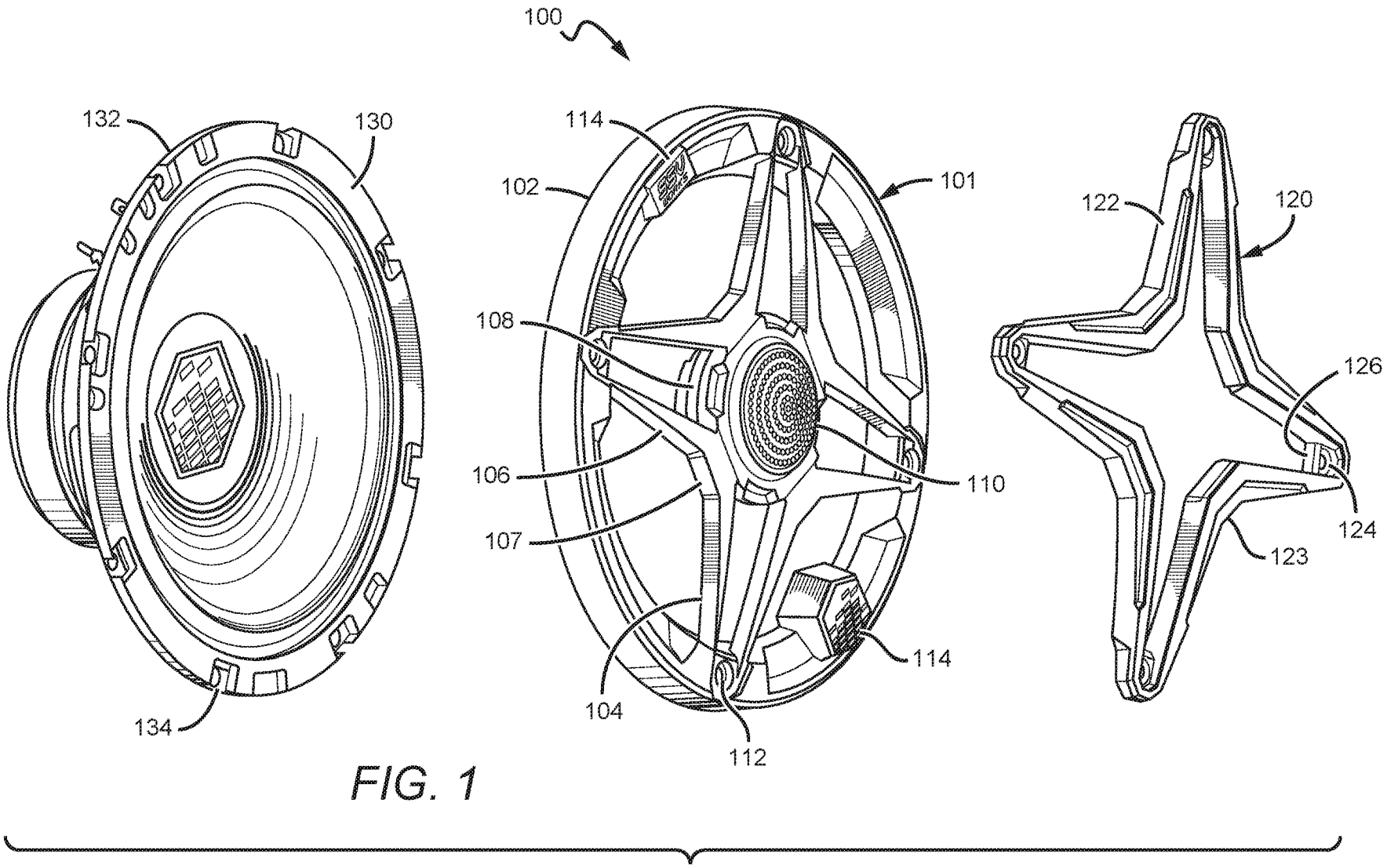
FIG. 1 is a top-left exploded view of a modular speaker cover according to one embodiment of the present invention and a speaker.

The present disclosure will now set forth detailed descriptions of various embodiments. These embodiments set forth modular speaker covers that can be efficiently replaced in part or whole with an alternate grille insert or modular speaker cover.

In some embodiments incorporating features of the present invention, the device comprises a modular grille and a grille insert. In some embodiments, the grille insert fits over and is removably attached to the modular grille and can be interchangeable with other grille inserts of various colors, shapes, and/or textures. In some embodiments, the modular grille and the grille insert are removably attached to the speaker using the same means of connection such as, for example, the same screws, by aligning holes in the modular grille and grille insert to holes in the speaker basket. The device can be configured to connect to the face of various types of speakers, such as speakers found in vehicles.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "attached," "connected" or "coupled" to another element, it can be directly attached, connected or coupled to the other element or intervening elements may be present. In contrast, when an element is referred to as being "directly attached," "directly connected" or "directly coupled" to another element, there are no intervening elements present.

Relative terms, such as "outer," "above," "lower," "below," "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

It is understood that when a first element is referred to as being "between," "sandwiched," or "sandwiched between," two or more other elements, the first element can be directly between the two or more other elements or intervening elements may also be present between the two or more other elements. For example, if a first element is "between" or "sandwiched between" a second and third element, the first element can be directly between the second and third elements with no intervening elements or the first element can be adjacent to one or more additional elements with the first element and these additional elements all between the second and third elements.

FIG. 1 shows an embodiment of a modular speaker cover device 100 incorporating features of the present invention. The modular speaker cover device 100 comprises a modular grille 101 and a grille insert 120. The modular grille 101 and the grille insert 120 are configured to cover at least part of the face of a speaker 130. The modular grille 101 and the grille insert 120 can comprise materials that have favorable acoustic qualities and that do not impede or negatively impact the sound produced by the speaker 130. Some suitable materials the modular grille 101 and the grille insert 120 can comprise include, but are not limited to, resin, rubber, vinyl, polyurethane, poly vinyl chloride (PVC), Poly(methyl methacrylate) (PMMA), polystyrene foam, polymers/copolymer substances, acrylic substances, plastic, metal, glass, fiberglass, wood or a combination thereof.

The modular grille 101 and the grille insert 120 can be formed by any suitable method, for example, molding, injection molding, stamping/pressing, three-dimensional printing, extrusion and/or any methods known in the art of sound equipment manufacturing. The modular grille 101 and the grille insert 120 can each be formed from multiple component parts, or one or more portions of the body can be formed together as a single part. Forming portions of the modular grille 101 together as a single part can improve the structural integrity of the modular grille 101. Similarly, forming portions of the grille insert 120 together as a single part can improve its structural integrity.

The modular grille 101 can comprise an outer frame 102, an inner frame 104, and a center frame 108. The outer frame 102 defines the peripheral shape of the modular grille and can form numerous shapes, such as a circular shape, quadrilateral shape, or hexagonal shape. The embodiment shown in FIG. 1 depicts a circular outer frame 102 shaped to closely fit over the speaker basket 132. In other embodiments, the outer frame 102 is of a shape different from that of the speaker basket 132 to which it is attached to give the appearance that the speaker is of a different shape.

In some embodiments, a grille mesh (not shown) is placed between the speaker 130 and the modular grille 101. The grille mesh can fully or partially cover the face of the speaker 130. One benefit to including a grille mesh is that the speaker is protected from small objects such as debris.

In the embodiment illustrated in FIG. 1, the inner frame 104 couples the outer frame 102 to the center frame 108. The inner frame 104 comprises grille arms 106, which can have flat surfaces, a rounded surface or surfaces, or a combination of flat and rounded surfaces. In some embodiments, the inner frame further comprises grille connectors 107, which join together neighboring arms and/or connect the grille arms 106 to the center frame 108. In some embodiments, the grille arms 106 connect the outer frame 102 to the center frame 108. In some embodiments, the arms can be positioned in pairs such that the distance between a pair of grille arms 106 is less than the distance between one of the grille arms 106 within the pair and a grille arm 106 with which it is not paired. In other embodiments, the grille arms 106 are grouped in sets of three or four or any number of arms. In still other embodiments, the grille arms 106 can be equidistant from each other and evenly spaced. In some embodiments, the grille arms 106 are joined directly to at least one neighboring grille arm 106 near or at the center frame 108. In some embodiments, a grille connector 107 can have flat surfaces, a rounded surface or surfaces, or a combination of flat and rounded surfaces. In some embodiments, the grille arms 106 and grille connectors 107 comprise a flat top surface and two flat lateral surfaces.

In some embodiments, the modular grille 101 also includes a center piece 110 within the center frame 108, which offers further protection to the face of the speaker 130. In some embodiments, the grille connectors 107 are concentric with the center frame 108 and connected to the most medial locations of the grille arms 106. The grille connectors 107 provide further structural stability to the modular grille 101. The grille connectors 107 are generally near or connected to the center piece 110, but they can connect to the grille arms 106 in various locations in other embodiments, such as between the outer frame 102 and the center frame 108, but separate from the center frame. Each grille connector 107 can also connect one or more grille arms 106 to the center frame 108. In some embodiments, the modular grille 101 further comprises aesthetic designs 114.

In some embodiments, the grille arms 106 are thicker by the center frame 108 than by the outer frame 102. This allows the modular grille 101 to have a rigid and durable structure while limiting the physical barriers that cover the speaker 130. The grille arms 106 can gradually and/or smoothly taper from the center frame 108 to the outer frame 102, or the thickness of the grille arms 106 can change incrementally. In other embodiments, the thickness of the grille arms 106 remains constant. In some embodiments, the thickness of the grille arms 106 varies according to a desired pattern for the modular grille 101.

The center frame 108 is located at the center of the modular grille 101. The center frame 108 connects to the grille arms 106 and/or the grille connectors 107. In some embodiments, the center piece 110 contains holes to enhance the transmission of emitted sound waves from the speaker 130 through the center piece 110. The holes can be positioned to form concentric circles around the center of the center piece 110, or they can be in various patterns. In some embodiments, the center piece 110 is removable from the center frame 108 to allow for replacement with an alternate center piece. In some embodiments, the center piece 110 is connected and/or integral to the center frame 108. In other embodiments, the center piece 110 is connected and/or integral to the grille insert 120.

In some embodiments, the modular grille 101 contains grille holes 112. The modular grille 101 is removably attached to the speaker basket 132 by screws inserted through the grille holes 112 and aligned basket holes 134, which are generally contained in speaker baskets for mounting the speakers and/or attaching speaker grilles. In some embodiments, the grille arms 106 connect to the outer frame 102 near the grille holes 112. In some embodiments, the grille holes 112 are between paired grille arms 106. In some embodiments, the modular grille 101 connects to the speaker basket 132 by alternate attachment mechanisms, such as adhesives, clasps, snap-fit fasteners, hook and loop attachment mechanisms, or any attachment mechanisms known within the field.

The grille insert 120 fits over at least a portion of the modular grill 101. FIG. 1 illustrates a grille insert 120 shaped to fit over the grille arms 106 and grille connectors 107 of the modular grille 101. The grille insert 120 is also shaped to fit over and/or around the grille holes 112. The grille insert 120 comprises insert arms 122, and insert connectors 123. In some embodiments, the insert arms 122 fit over the top and lateral portions of the grille arms 106 such that the grille arms 106 are not visible. In some embodiments, the insert connectors 123 fit over the top and at least partially over the lateral portions of the grille connectors 107 such that the grille connectors 107 are not visible. The grille insert 120 can also provide additional structural support to the modular speaker cover 100.

In some embodiments, the grille insert 120 further comprises attachment areas 126 at the ends of the insert arms 122. In some embodiments, the attachment areas 126 comprise an insert hole 124 within a connection between adjoining insert arms 122. The insert holes 124 align with grille holes 112 when the grille insert 120 is on the modular grille 101. Attachment mechanisms, such as screws, fit through the insert holes 124 and the grille holes 112 and into the basket holes 134. Thus, the grille insert 120 is removably attached to the speaker 130 via the same means, with the same mechanisms with which the modular grille 101 is attached to the speaker 130. In some embodiments, the grille insert 120 connects to the modular grille 101 by alternative attachment mechanisms known within the art, such as adhesives, clasps, snap-fit fasteners, or hook and loop attachment mechanisms. In some embodiments, the grille insert 120 attaches to the speaker 130 by a means different from the means by which the modular grille 101 attaches to the speaker 130 and/or at a location other than where the modular grille 101 attaches to the speaker 130.

In some embodiments, the modular grille 101 comprises recessed areas where the grille insert 120 fits over the modular grille 101. These recessed areas can be in various locations on the modular grille 101, such as surrounding and/or near the grille holes 112. These recessed areas allow for the grille insert 120 to have a secure and integrated fit with the modular grille 101.

Figure 2:
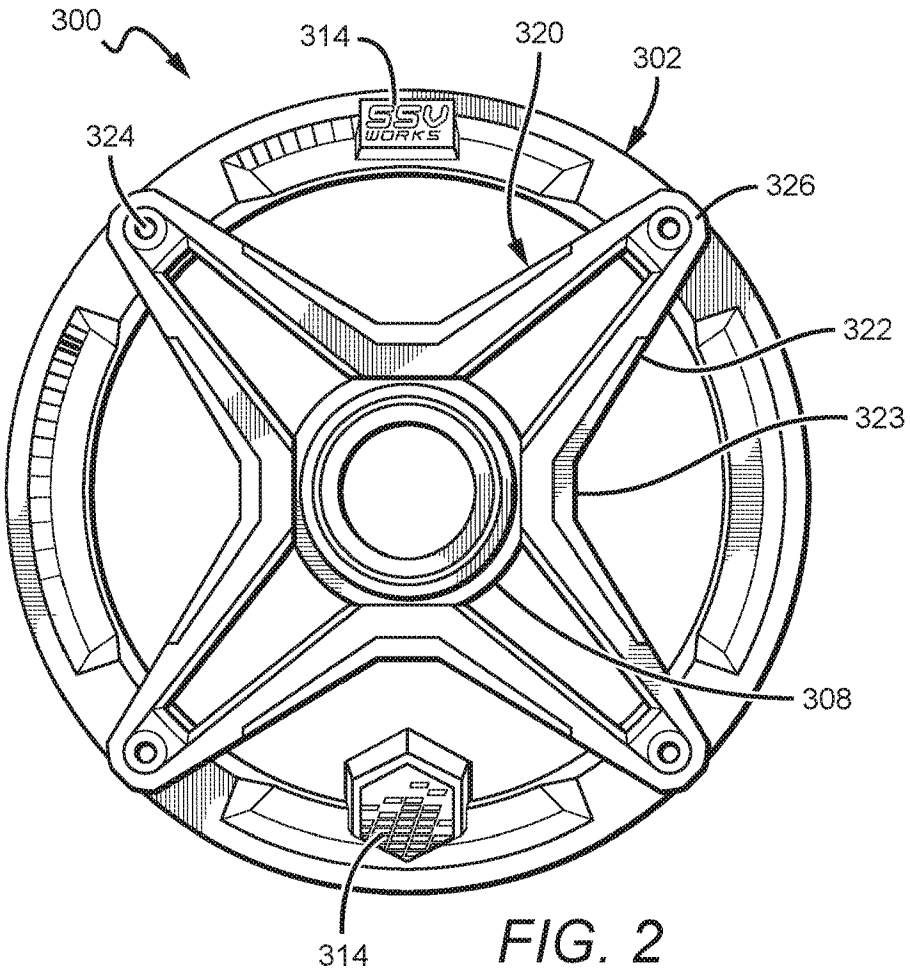
FIG. 2 is a top view of a modular speaker cover according to another embodiment of the present invention.

FIG. 2 shows a modular speaker cover 300 according to another embodiment of the present invention. Similar to the embodiment illustrated in FIG. 1, the modular speaker cover 300 comprises a modular grille 301 and a grille insert 320. The modular grille 301 comprises an inner frame 304 (not visible in FIG. 2, but shown in FIG. 4) connecting an outer frame 302 to a center frame 308. In some embodiments, the modular grille 301 further comprises aesthetic designs 314. The grille insert 320 comprises insert arms 322, insert connectors 323, and attachment areas 326. In some embodiments, each attachment area 326 comprises an insert hole 324 within a connection between adjoining insert arms 322. The grille insert 320 fits onto the modular grille 301. In some embodiments, as in FIG. 2, the grille insert 320 covers all of the inner frame 304. In other embodiments, the grille insert 320 covers only part of the inner frame 304. In yet other embodiments, the grille insert 320 does not cover any of the inner frame 304.

Figure 3:
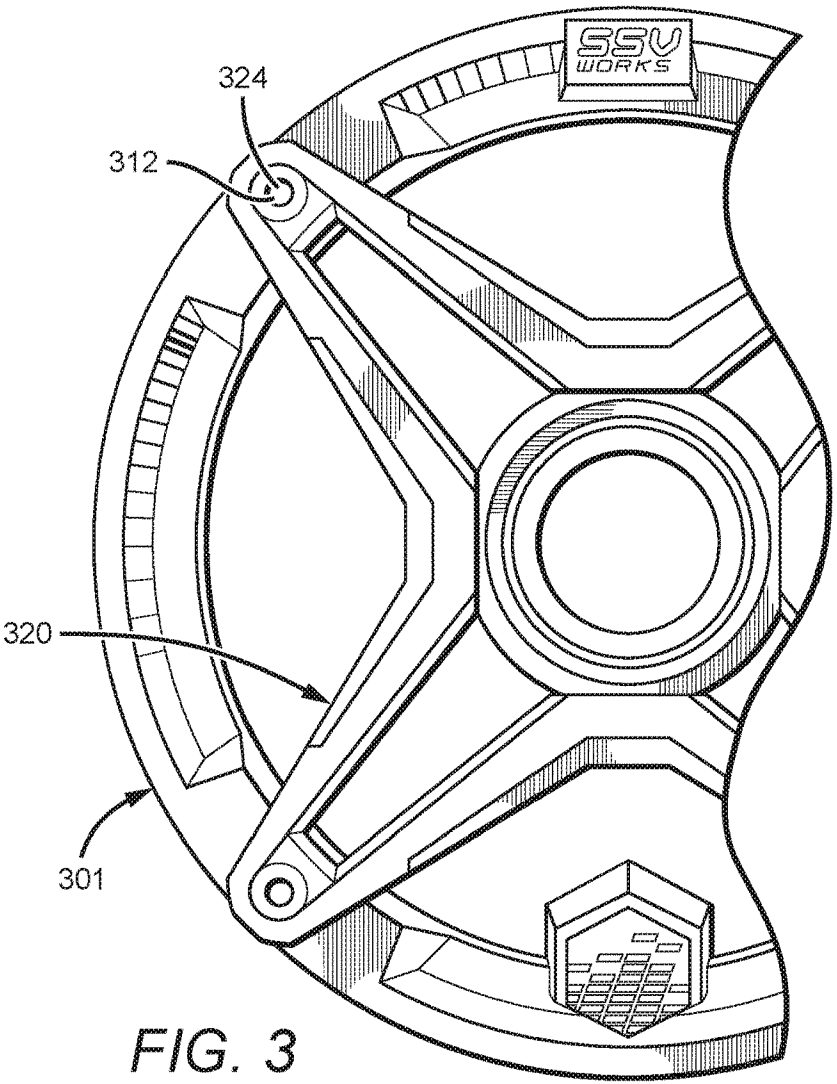
FIG. 3 is a magnified top view of a modular speaker cover according to the embodiment of the present invention shown in FIG. 2.

FIG. 3 shows a magnified top view of a modular speaker cover 300 illustrated in FIG. 3, which clearly depicts the alignment of the grille holes 312 and the insert holes 324 when the grille insert 320 is on the modular grille 301. This alignment allows both the modular grille 301 and the grille insert 320 to be removably attached to the speaker via the same attachment mechanisms such as, for example, screws. Once screws are inserted in the insert holes 324, the grille holes 312, and the basket holes 134, the grille insert 320 becomes securely fixed to the modular grille 301 and the speaker 130.

Figure 4:
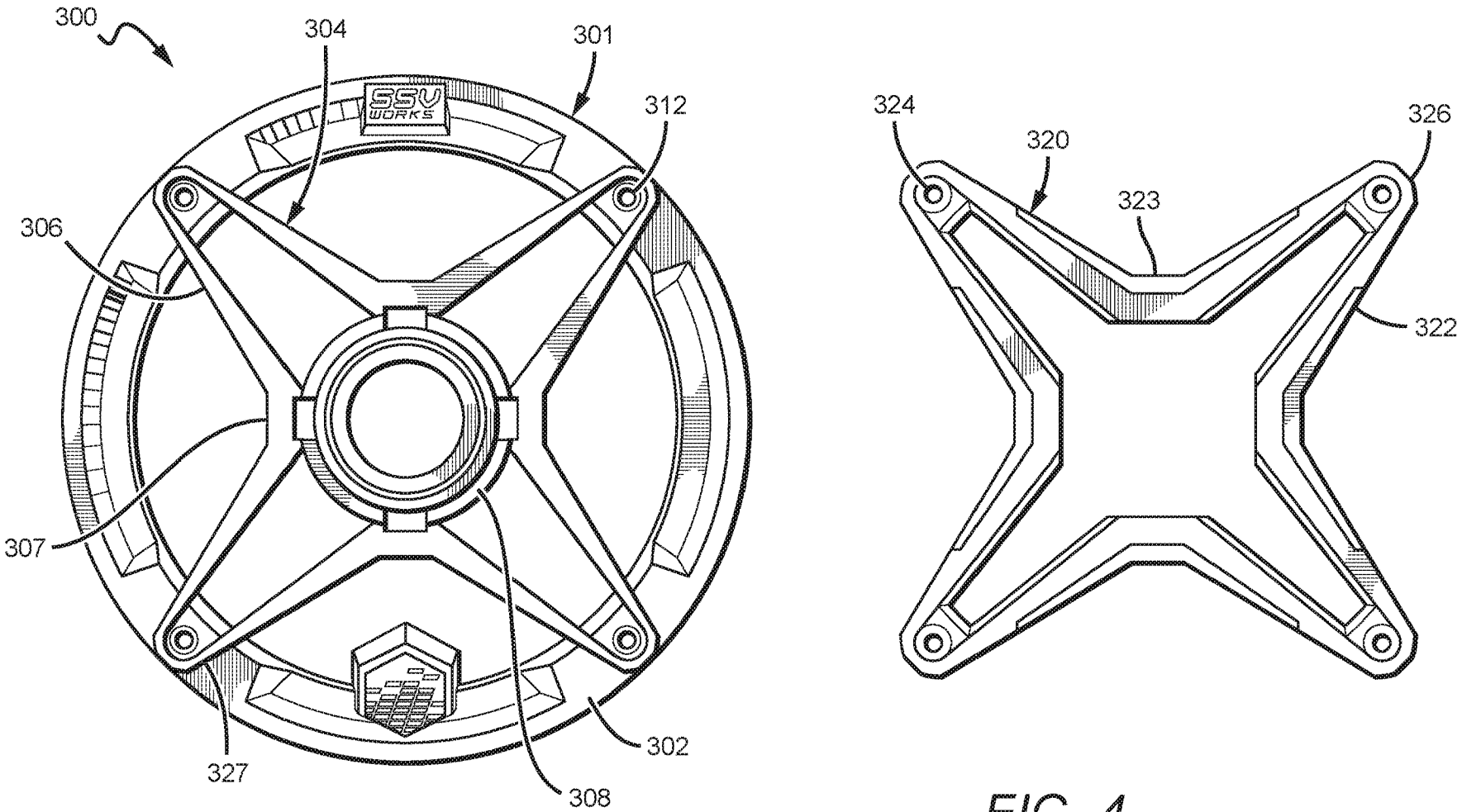
FIG. 4 is a top exploded view of a modular speaker cover according to the embodiment of the present invention shown in FIG. 2.

FIG. 4 illustrates the top side of the grille insert 320 unattached from the modular grille 301. In this view the modular grille's inner frame 304 is visible. The inner frame 304 connects the outer frame 302 to the center frame 308, and comprises the grille arms 306 and the grille connectors 307. In this embodiment, the grille insert 320 mimics the shape of the grille arms 306 and the grille connectors 307. The grille holes 312 and the insert holes 324 are located such that they align with each other when the grille insert 320 is attached to the modular grille 301. In other embodiments, the grille insert 320 may be of a different shape than that of the grille arms 306 and the grille connectors 307. The modular grille 301 comprises grille indentations 327 where the grille arms 306 connect to the outer frame 302 for receiving the attachment areas 326. In some embodiments, the grille insert 320 further comprises curtains 309 (shown in FIG. 5) along the insert arms 322 and insert connectors 323 that cover the lateral surfaces of the grille arms 306 and the grille connectors 307, while leaving the bottom surface of the grille arms 306 and grille connectors 307 uncovered.

FIG. 5 shows the bottom sides of the curtains 309 on the grille insert 320 while attached to the modular grille 301.

Figure 6:
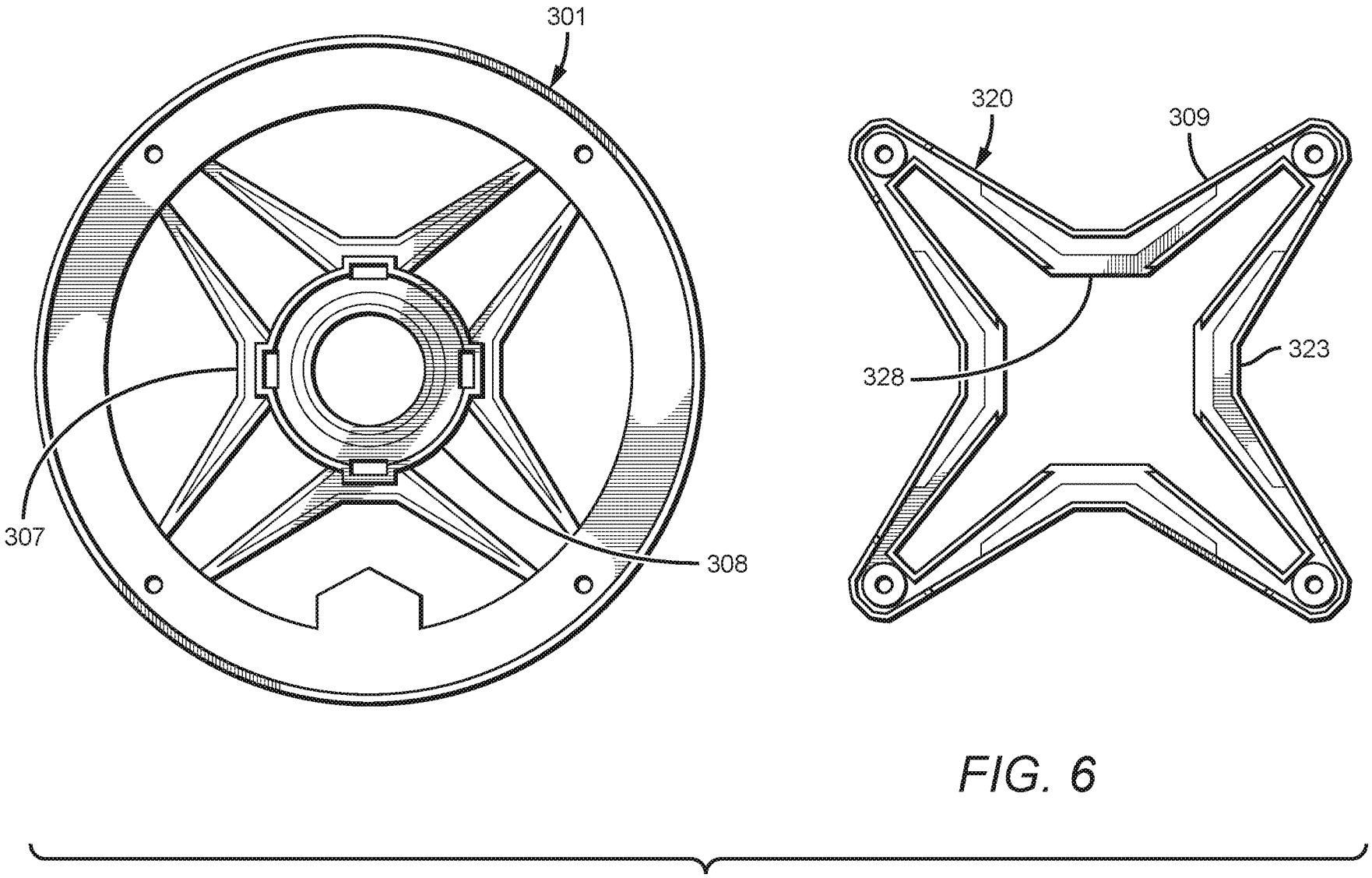
FIG. 6 is a bottom exploded view of a modular speaker cover according to the embodiment of the present invention shown in FIG. 2.

FIG. 6 illustrates the bottom sides of the grille insert 320 and the modular grille 301 while they are unattached. The grille insert 320 comprises connector receptors 328 along the insert connectors 323. The connector receptors 328 are essentially the absence of curtains 309, and are positioned along the insert connectors 323 where the insert connectors 323 fit over the junction of the grille connectors 307 and the center frame 308.

FIG. 7 is a top perspective view of the grille insert 320. As shown, the connector receptors 328 are located at the most medial positions of the grille insert 320, and the attachment areas 326 are located at the most lateral positions of the grille insert 320. The grille insert 320 attaches to the outer frame 302 of the modular grille 301 at the attachment areas 326. The modular grille 301 comprises grille indentations 327 where the grille arms 306 connect to the outer frame 302 for receiving the attachment areas 326 (as shown in FIG. 4). Similarly, the attachment areas 326 located at the ends of the insert arms 322 comprise insert indentations 329 to better couple with the modular grille 301.

FIG. 8 illustrates the bottom of the grille insert 320, particularly the curtains 309, the connector receptors 328, and the attachment areas 326 comprising the insert holes 324. As shown, the insert connectors 323 only have curtains 309 along the lateral or outside portion of the insert connectors 323, because the connector receptors 328 are located along the medial or inside portion of the insert connectors 323.

FIG. 9 shows another embodiment of a modular speaker cover 400 comprising a single unit rather than a separate modular grille 101 and grille insert 120. This embodiment functions similarly to the modular speaker cover 100, but as if the grille insert 120 were permanently attached to the modular grille 101. Thus, the modular speaker cover as a whole is removably attachable to the speaker 130. A grille mesh (not shown) can be placed between the speaker and the speaker cover 400.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the claims, wherein no portion of the disclosure is intended, expressly or implicitly, to be dedicated to the public domain if not set forth in any claims.

We claim:

1. A modular speaker cover for covering a speaker, comprising:

a modular grille comprising an outer frame, a center frame, and at least one arm between said outer frame and said center frame, said at least one arm comprising lateral surfaces;

a grille insert, said insert removably attachable to said modular grille such that said grille insert substantially covers said at least one arm, said grill insert comprising insert arms, wherein said insert arms comprise curtains, said curtains configured to substantially cover said lateral surfaces of said at least one arm between said outer frame and said center frame;

wherein said modular grille is configured to removably attach to a speaker such that said modular grille at least partially covers the face of the speaker.

2. The device of claim 1, wherein said modular grille and said grille insert are attachable to the speaker by at least one attachment mechanism.

3. The device of claim 1, wherein said at least one arm comprises a top surface and two lateral surfaces, wherein said grille insert at least partially covers said top and lateral surfaces of said at least one arm.

4. The device of claim 1, wherein said grille insert is a single unit.

5. The device of claim 1, wherein said grille insert is removably attachable to said outer frame.

6. The device of claim 1, wherein said outer frame comprises at least one indentation, said at least one indentation shaped to receive part of said grille insert.

7. The device of claim 1, wherein said center frame comprises a center piece.

8. The device of claim 1, wherein said outer frame and said grille insert each further comprise:

at least one hole, where said at least one hole of said outer frame and said at least one hole of said grille insert align when said grille insert is attached to said modular grille.

9. A modular speaker cover for covering a speaker, comprising: a modular grille comprising an outer frame, a center frame, and a plurality of arms between said outer frame and said center frame, said plurality or arms comprising lateral surfaces; and an grille insert on said modular grille, said grille insert being removably attached to said modular grille, said grill insert comprising insert arms, wherein said insert arms comprise curtains, said curtains configured to substantially cover said lateral surfaces of said plurality of arms between said outer frame and said center frame;

wherein said grille insert is configured to removably attach to the speaker by a plurality of attachment mechanisms.

10. The device of claim 9, wherein said at least one arm comprises a top surface and two lateral surfaces, wherein said grille insert at least partially covers said top and side portions of said at least one arm.

11. The device of claim 9, wherein said grille insert is a single unit.

12. The device of claim 9, wherein said grille insert is removably attachable to said outer frame.

13. The device of claim 9, wherein said outer frame comprises at least one indentation, said at least one indentation shaped to receive part of said grille insert.

14. The device of claim 9, wherein said center frame comprises a center piece.

15. The device of claim 9, wherein said outer frame and said grille insert each further comprise:

at least one hole, where said at least one hole of said outer frame and said at least one hole of said insert align when said grille insert is attached to said modular grille.

* * * * *